United States Patent [19]

Schosek

[11] 4,247,222

[45] Jan. 27, 1981

[54] STABILIZING MEANS FOR AN UNDERGROUND PIPE INSTALLER DEVICE

[76] Inventor: William O. Schosek, 7942 Marx Dr., North Fort Myers, Fla. 33903

[21] Appl. No.: 68,151

[22] Filed: Aug. 20, 1979

[51] Int. Cl.[3] ..... E02F 5/10

[52] U.S. Cl. ..... 405/184; 175/220; 405/272

[58] Field of Search ..... 405/184, 272, 273, 282; 175/220, 76, 62; 173/35

[56] References Cited

U.S. PATENT DOCUMENTS

| | | | |
|---|---|---|---|
| 1,639,731 | 8/1927 | Humiston | 405/184 X |
| 2,274,431 | 2/1942 | Renner | 405/184 X |
| 2,482,367 | 9/1949 | Rarers | 405/282 |
| 2,796,738 | 6/1957 | Moore | 405/282 |
| 2,971,582 | 2/1961 | Marsh | 175/76 X |
| 3,263,430 | 8/1966 | Bryan | 405/282 |
| 3,477,762 | 11/1969 | Frenyo et al. | 175/62 X |
| 3,486,572 | 12/1969 | Hamilton et al. | 175/220 X |
| 3,653,716 | 4/1972 | Hattrup | 175/62 X |
| 3,861,748 | 1/1975 | Cass | 175/76 X |

FOREIGN PATENT DOCUMENTS

| | | | |
|---|---|---|---|
| 2810386 | 3/1979 | Fed. Rep. of Germany | 405/282 |
| 1535655 | 7/1968 | France | 405/282 |
| 1212361 | 11/1970 | United Kingdom | 405/282 |
| 160492 | 5/1964 | U.S.S.R. | 405/282 |

*Primary Examiner*—Dennis L. Taylor

*Attorney, Agent, or Firm*—Alfred E. Wilson

[57] ABSTRACT

A stabilizer structure for an underground pipe installer device comprised of a pair of adjustable, oppositely, outwardly extending stabilizing abutments, fixed to the rear end portion of an underground pipe installer device. A compound scissors linkage is pivotally mounted relative to an upstanding post fixed to the rear end portion of the installer device, with upper and lower pairs of links thereof being mounted between fixed pivots respectively carried by the post and abutments, and an intermediate pair of links connecting between fixed pivots at outer ends, carried by the respective abutments, and pivots at their respective inner ends carried by a traveling nut, threaded on an elongated screw rod, anchored in a vertical attitude between the three pairs of links, for rotational operation to selectively move the pair of abutments inwardly or outwardly relative to each other.

10 Claims, 3 Drawing Figures

STABILIZING MEANS FOR AN UNDERGROUND PIPE INSTALLER DEVICE

BACKGROUND OF THE PRESENT INVENTION

It is frequently necessary to install an underground pipe between two given points such as the opposed sides of a finished street or driveway, for example. It is routine procedure to provide an operating trench on one side and a target trench on the opposed side, and an installer device is properly positioned in the operating trench.

A first rod length is manually inserted through drive jaw means of the installer device and engaged thereby to push said first rod length toward the target trench, generally by a fluid operated cylinder and piston assembly. The trailing end of the first rod length is provided with a coupling to receive a second rod length and the drive means is activated to push the second rod length forwardly toward the target trench. A sufficient plurality of rod lengths are similarly attached to preceding lengths and driven forwardly until the leading tip end of the first rod length emerges into the target trench.

The leading trip end is threadedly provided with a pusher cap which is removed and replaced with an adapter for attachment to an end of a pipe to be permanently installed under the above surface. For this purpose, the direction of movement is reversed to pull the rods with the pipe attached thereto back through the hole, formed by the rod, until the leading end of the pipe emerges into the operating trench.

The above described operations are quite conventional, however, it is essential to stabilize the installer device during the rod pushing operation. It is particularly essential to stabilize the rear end of the device to keep the rod on a true course through the soil. Normally, the penetration of the pipe into the soil will stabilize the front end if the rear end is stabilized, and, stabilizing the rear end prevents a twisting or pivotal movement of the installer device which would permit the rod to deviate from its intended path of penetration.

Therefore, one of the principal objects of the present invention is to provide a pair of adjustable, vertically disposed abutment members on opposed sides of the rear end of the underground pipe installer device, to maintain the device in a properly centered aligned disposition within the operating trench during the rod pushing operation.

A further object of the invention is to provide a compound scissors linkage between the rear end of the installer device and the respective abutments with the linkage being operably connected to a vertical screw shaft, having an extended upper end, shaped and configurated for reception in the socket of an elongated wrench for manipulation of the abutments from a position outside of the operating trench.

DESCRIPTION OF A PREFERRED EMBODIMENT

Figures 1, 3:
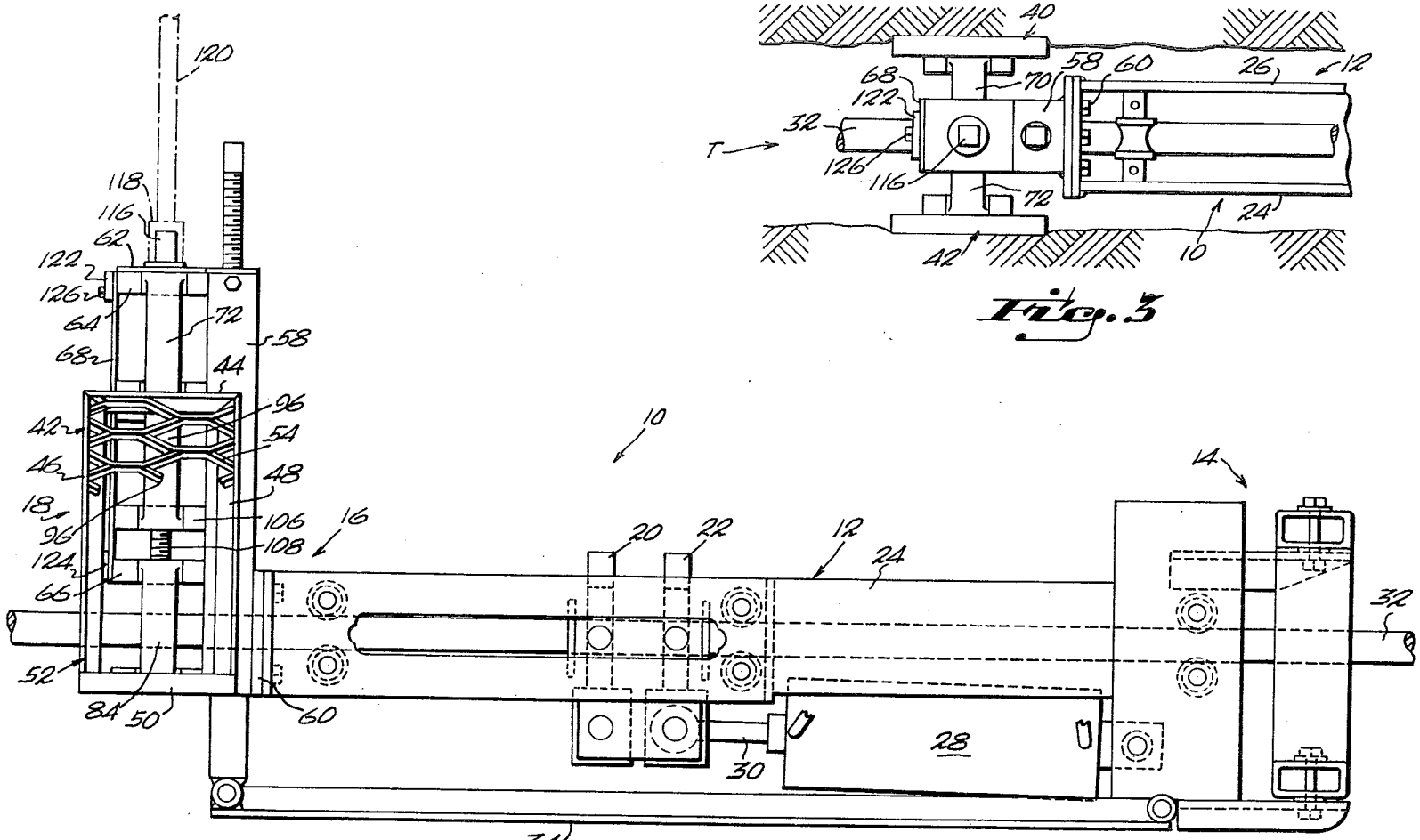
FIG. 1 is a side elevational view of an underground pipe installer device, incorporating the stabilizing means of the present invention.
FIG. 3 is a fragmentary top plan view of the rear end of the device, including the stabilizing means, disposed in the operating trench.

With reference to the drawings, and particularly to FIG. 1, an underground pipe installer device, designated generally at 10, includes a main central length 12, a forward end portion 14, and a rear end portion 16 incorporating the stabilizing means 18 of the present invention. A pair of reciprocal drive jaws 20, 22 are disposed between side walls 24, 26 of the main central length 12 for operation by a fluid operated cylinder and piston assembly 28, 30 to, first, drive a rod assembly 37, comprised of a plurality of coupled rod lengths through the ground in a hole forming operation and, second, to withdraw a pipe, coupled to the leading tip end of the rod 32, through the hole to the operating trench T. The device is supported by a base 34.

Figure 2:
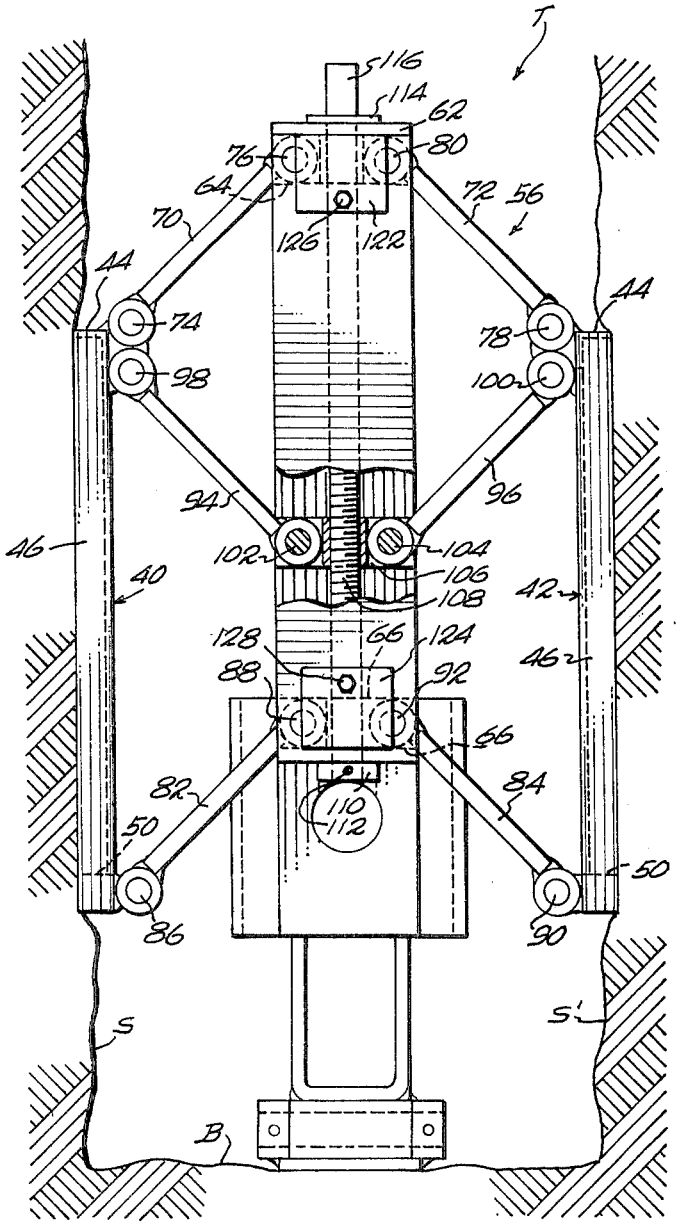
FIG. 2 is an enlarged rear elevational view of the device in a stabilized condition within the operating trench.

With particular reference to FIGS. 2 and 3, the device 10 is disposed in an operating trench T including a bottom surface B and generally vertical side walls S and $S^1$. With the base 34 of the installer device 10 disposed on the bottom surface B, a pair of opposed side abutment members 40, 42 are adapted for mevement into tight engagement with the trench side walls S and $S^1$ to stabilize the rear end portion 16. In a preferred form the abutment members 40, 42 are generally rectangular, each being formed of top, and side angle irons 44, 46 and 48 with a tubular bottom span 50. As illustrated in FIG. 1, the area within the peripheral frame 52, defined by members 44 through 50, is filled with a heavy expanded steel plate 54.

A compound scissors linkage 56 is pivotally carried between an upstanding rear end post 58, fixed at 60 to the rear ends of side walls 24, 26, and a welded assembly, FIG. 1, comprised of post 58, a top plate 62, top and bottom bearing plates 64, 66 and an upstanding end plate 68. Referring to FIG. 2, a top pair of idler scissors links 70, 72 are respectively carried on pivot pins 74, 76 and 78, 80, fixed relative to top ends of abutment plates 20, 22 and top bearing plate 64. A similar pair of bottom idler scissors links 82, 84 is similarly pivotally attached at 86, 88 and 90, 92 at the bottom of the abutment plate assembly.

An intermediate pair of scissors links 94, 96 are pivotally attached at top end pivot pins 98, 100, adjacent pivot pins 74, 78, and a pair of pivot pins 102, 104 extending through a traveling nut 106, screw threaded onto a generally vertically extending screw shaft 108, retained in a central position relative to the scissors linkage by a collar 110 pinned at 112 outwardly of bottom bearing plate 66, and an annular flange 114 atop top plate 62. Top end 116 of screw shaft 108 is configurated for reception in a socket 118, FIG. 1, of an elongated wrench 120, for remote operation of the abutment members 20, 22 into and out of engagement with trench walls S and $S^1$. Abutment members 20, 22 may be moved to expand the distance therebetween to an extent determined by the lengths of the links or retracted within the confines of the widest portion of the device 10 by remote operation of wrench 120.

The trench width illustrated in FIGS. 2 and 3 is substantially wider than normally employed for illustration purposes, the width normally being in the nature of an inch or two greater than the width of the device 10, 6 inches, for example.

For replacement or repair purposes, the pivot pins 76, 80, and 88, 92 may be removed after removal of the top and bottom retainer plates 122, 124 by means of screws 126, 128, and the screw shaft 108 may be threaded out of engagement with traveling nut 106 upon removal of bottom collar 110, by means of pin 112. The entire compound scissors linkage may then be removed.

I claim:

1. A stabilizing means for attachment to an underground pipe installer device of a type normally positioned in an operating trench, and including means for, first, driving a rod assembly, comprised of a plurality of coupled rod lengths, through the ground for penetration into a remote target trench and, second, for withdrawing a pipe or the like, attached to a leading tip end of the rod, rearwardly through a hole formed by the rod, for penetration into the operating trench, the stabilizing means comprising, a support means fixed relative to a main frame of the installer device in a generally vertically centered, transverse relation above the rod, a pair of generally vertically disposed abutment members positioned respectively on opposed sides of said support means, pivotal link means fixed to said abutment members, means to selectively actuate said pivotal link means to cause relative movement of said abutment members toward or away from each other; idler means pivotally connecting between said abutment members and support means.

2. The stabilizing means as defined in claim 1 wherein said support means is comprised of a pair of generally upstanding spaced apart support members, fixed relative to an end portion of the installer device and connected by upper and lower bearing blocks.

3. The stabilizing means as defined in claim 2 wherein said idler means comprises upper and lower pairs of scissors links pivotally connected at respective inner ends through said upper and lower bearing blocks, and pivotally connected at respective outer ends, to upper and lower confronting portions of said pair of abutment members.

4. The stabilizing means as defined in claim 3 wherein said pivotal link means comprises an intermediate pair of scissors links connected at respective inner ends to a traveling nut, and at outer ends to confronting portions of said pair of abutment members, said upper, lower and intermediate pairs of scissors links being of like lengths to co-act in a manner so as to maintain said abutment members in a generally vertical parallel relation throughout a predetermined range of movement, determined by said lengths.

5. The stabilizing means as defined in claim 4 wherein said means to actuate comprises an elongated screw shaft, engaged by said traveling nut.

6. The stabilizing means as defined in claim 5 including means to confine said screw shaft for rotational movement only.

7. The stabilizing means as defined in claim 6 including an upwardly outwardly extended end on said screw shaft, sized and configurated for reception in a socket of an elongated wrench for remote actuation of said screw shaft.

8. The stabilizing means as defined in claim 3 wherein said inner end pivotal connections includes upper and lower pairs of pivot pins normally confined against displacement by upper and lower retainer plates, each of which is fixed by a screw to one of said support members in an overlying relation with at least a portion of each pivot pin of one of said pairs thereof.

9. The stabilizer as defined in claim 1 wherein each of said abutment members is generally rectangular in configuration.

10. The stabilizer as defined in claim 9 wherein each of said abutment members includes a peripheral frame and a heavy expanded metal plate, fixed to said frame and spanning the area defined therewithin.

* * * * *